US009713577B2

(12) United States Patent
Lepine

(10) Patent No.: US 9,713,577 B2
(45) Date of Patent: Jul. 25, 2017

(54) FLOW WARNING BABY BOTTLE HOLDER

(71) Applicant: SLOW CONTROL, Saint Paul (FR)

(72) Inventor: Jacques Lepine, Paris (FR)

(73) Assignee: Jacques Lepine, Paris (FR)

( * ) Notice: Subject to any disclaimer, the term of this patent is extended or adjusted under 35 U.S.C. 154(b) by 0 days.

(21) Appl. No.: 15/330,104

(22) PCT Filed: Feb. 10, 2015

(86) PCT No.: PCT/FR2015/000030
§ 371 (c)(1),
(2) Date: Aug. 8, 2016

(87) PCT Pub. No.: WO2015/121552
PCT Pub. Date: Aug. 20, 2015

(65) Prior Publication Data

US 2016/0354286 A1 Dec. 8, 2016

(30) Foreign Application Priority Data

Feb. 14, 2014 (FR) ..... 14 00413

(51) Int. Cl.
*A61J 9/06* (2006.01)

(52) U.S. Cl.
CPC ..... *A61J 9/0638* (2015.05); *A61J 9/06* (2013.01); *A61J 9/0676* (2015.05); *A61J 9/0684* (2015.05); *A61J 2200/74* (2013.01); *A61J 2200/76* (2013.01); *A61J 2205/70* (2013.01)

(58) Field of Classification Search
CPC A61J 9/06; A61J 9/0638; A61J 9/0646; A61J 2200/70; A61J 2200/74; A61J 2200/76
USPC ..... 340/613; 215/11.1, 395
See application file for complete search history.

(56) References Cited

U.S. PATENT DOCUMENTS

| | | | | |
|---|---|---|---|---|
| 7,663,497 | B2 * | 2/2010 | Chishima | G01G 17/04 340/539.1 |
| 9,445,969 | B2 * | 9/2016 | Huang | A61J 1/03 |
| 2013/0222135 | A1 * | 8/2013 | Stein | A61J 7/0409 340/540 |
| 2014/0311239 | A1 * | 10/2014 | Marjanovic | G01F 23/20 73/296 |

* cited by examiner

*Primary Examiner* — Kevin Kim

(57) ABSTRACT

Baby bottle holder that warns of the poor flow of a baby bottle with teat, bottle bottom teat ring offering up/down maintenance of the baby bottle and a lateral maintenance (45) of the baby bottle which prevents the baby bottle from getting out of his up/down maintenance and which provides a gripping surface to hold the bottle holder characterized in that the bottle holder (40) holds the bottle up and down from top on the upper face of the screwing ring (10) and from the base on the bottom, the bottle holder comprises a weight sensor (42) which captures the weight exerted by the upper face of the screwing ring (10), a weight sensor which senses the weight exerted on the side wall (41) of the bottle, a weight sensor (43) which senses the weight exerted on the bottom of the baby bottle, an inclinometer which senses the inclination of the baby bottle, an accelerometer that senses the vibration of the baby bottle and therefore of the teat, a transceiver module that transmits the data wireless to a remote terminal, a visual, audible or vibrating alarm that restitutes an alarm to the parent.

2 Claims, 1 Drawing Sheet

FLOW WARNING BABY BOTTLE HOLDER

The present invention concerns a smart bottle holder.

The invention aims to improve a performance of the bottle which is that of good liquid flow to the baby. In fact, the bottles have defects on the quality of the flow delivered to the baby. The first flaw is that sometimes teats clog. These are often lumps that come to clog the teat. It takes some time to realize the situation. During that time the baby sucks with no result and get exhausted. A second flaw is that sometimes the baby can suck air. This happens especially when the bottle is insufficiently angled regarding to the liquid level in the bottle.

A primary object of the invention is to check the quality of the bottle flow and notify the parent if the bottle is either clogged or misangled.

Another object of the invention is to provide an overview of the history of the meals taken by a baby.

Another object of the invention to provide the parent a tool for monitoring the baby's food intake.

Another object of the invention is to provide an alarm tool to the parent to warn if the intake is inadequate or too slow or too fast.

Another object of the invention is to notify the parent if the baby is swallowing air while drinking.

In a main aspect, the invention provides an intelligent bottle holder that tracks the flow of how the bottle is taken.

In one aspect, the invention provides a bottle holder that captures the weight of liquid in the bottle.

In one aspect, the invention provides a bottle carrier that captures the angle of the bottle with respect to the vertical and the flow of liquid and or air in the teat.

In one aspect, the invention provides a bottle holder that captures if the baby is swallowing air while drinking.

In one aspect the invention gathers all the captured data and transmits them through wired or wireless link to a remote terminal such as a smart phone.

The attached figures represent a particular embodiment of the invention in which.

Figure 1:
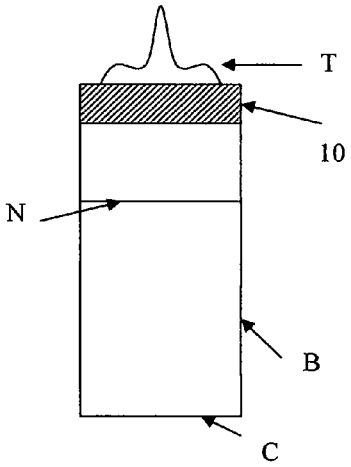
FIG. 1 shows a conventional baby bottle standing vertical
Figure 2:
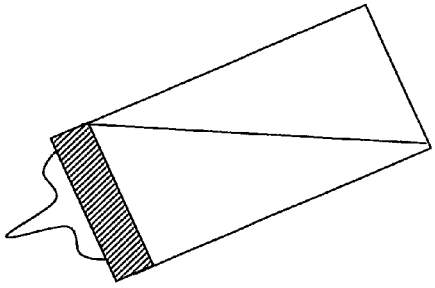
FIG. 2 shows a conventional baby bottle leaning that delivers milk
Figure 3:
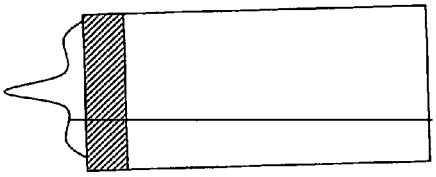
FIG. 3 shows a conventional baby bottle leaning that delivers air
Figure 4:
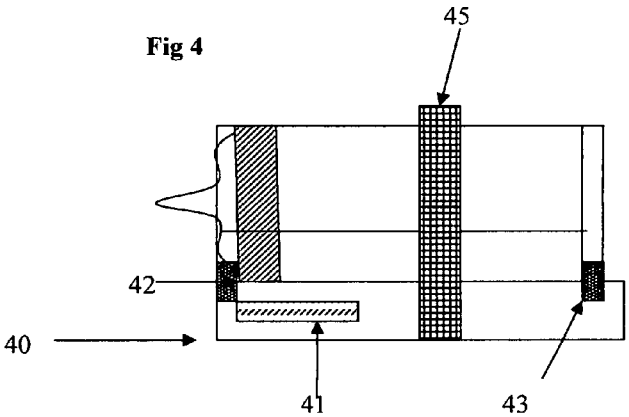
FIG. 4 shows the bottle holder according to the invention which captures the data relative to the liquid flow, the liquid weight, the angle with respect to the horizontal.

FIG. 1 shows a conventional baby bottle vertically with its bottle (B), the bottom (C) of its bottle, its teat screwing ring (10), its teat (T). The teat screwing ring (10) has a side face which follows the side wall of the bottle and an upper face that comes partially close the bottle. A hole is disposed on the top of the screw ring to insert the teat through which the baby will suckle. FIG. 2 shows a conventional baby bottle leaning that delivers milk. In this figure, the liquid reaches the teat and the baby may therefore drink. FIG. 3 shows a conventional baby bottle leaning which supplies air as in this physical layout, the bottle is insufficiently angled. It therefore delivers air. FIG. 4 shows the bottle holder (40) according to the invention which captures the data relative to the liquid flow, the liquid weight, the angle with respect to the horizontal. To do this, the invention proposes a bottle holder (40) which comes hold the bottle up and down from the top on the upper face of the screwing ring (10) and from the base on the bottom (C). The bottle holder also provides lateral support (45) which prevents the bottle from getting out of his high/low maintenance and which also provides the parent a gripping surface to hold the bottle holder.

The bottle holder comprises

- A weight sensor which senses the weight exerted by the upper face of screwing ring (10)
- A weight sensor which senses the weight exerted on the side wall of the bottle
- A weight sensor which senses the weight exerted on the bottom of the bottle
- An inclinometer that captures the inclination of the bottle
- An accelerometer which senses the vibrations of the bottle and therefore of the teat
- A transceiver module that transmits the data to a remote terminal wireless
- A visual, audible or vibratory alarm that restitutes an alarm to the parent.

It is well understood that the alarm can also be exported to the smart phone.

The invention thus captures the weight present in the bottle, tilt, vibration and thus calculates whether the baby suckle in the void, so swallows air or get exhausted on a lump. If this is the case the invention restitutes an alarm to the parent.

The present invention therefore provides a bottle holder that warns of the poor liquid flow of a baby bottle (B) with teat (T), teat ring (10) bottle bottom (C) offering a high/low maintenance of the baby bottle and side maintenance (45) of the baby bottle which prevents the bottle from getting out of his high/low maintenance and provides a gripping surface to hold the bottle holder wherein the bottle holder (40) holds the baby bottle up and down from the top on the upper face of the screwing ring (10) and from the the base on the bottom (C), the bottle holder comprises a weight sensor (42) which captures the weight exerted by the upper face of the screwing ring (10), a weight sensor which senses the weight exerted on the side wall of the bottle (41), a weight sensor (43) which senses the weight exerted on the bottom of the bottle, an inclinometer which senses the inclination of the bottle, an accelerometer which senses the vibrations of the bottle and therefore of the teat, a powered electronic processing circuit, and a transceiver module that transmits the data wireless to a remote terminal, a visual, audible, or vibratory alarm which restitutes an alarm the parent.

The present invention provides a bottle holder characterized in that it comprises a lateral maintenance (45) which prevents the bottle from getting out of his high/low maintenance and also provides the parent a gripping surface to hold the bottle holder The invention is also able to determine the history of eating meals: meal time, total intake, rate during the meal.

It is therefore well understood that many variations of the invention may register under the present invention.

The invention clamied is:

1. Bottle holder that warns of the poor liquid flow of a baby bottle (B) with teat (T), teat ring (10) bottle bottom (C) offering a high/low maintenance of the baby bottle and a lateral maintenance (45) of the baby bottle which prevents the bottle from getting out of his high/low maintenance and provides a gripping surface to hold the bottle holder wherein the bottle holder (40) holds the bottle up and down from the top on the upper face of the screwing ring (10) and from the base on the bottom (C), the bottle holder comprises a weight sensor (42) which captures the weight exerted by the upper face of the screwing ring (10), a weight sensor that captures the weight exerted on the side wall of the bottle (41), a weight sensor (43) which senses the weight exerted on the bottom of the bottle, an inclinometer which senses the inclination of the baby bottle, an accelerometer that senses the vibration of the baby bottle and thus of the teat, a powered electronic processing circuit, and a transceiver module that transmits the data wireless to a remote terminal, a visual, audible or vibrating alarm that restitutes an alarm to the parent.

2. Bottle holder according to the claim 1, characterized in that it comprises a lateral maintenance (45) which prevents the bottle from getting out of his high/low maintenance and also provides the parent a gripping surface to hold the bottle holder.

* * * * *